US006092687A

United States Patent [19]

Hupp et al.

[11] Patent Number: 6,092,687

[45] Date of Patent: Jul. 25, 2000

[54] COLLAPSIBLE, STACKABLE, SELF-SUPPORTING CONTAINER WITH SUPPLEMENTAL SUPPORT FEATURE

[75] Inventors: Matthew Todd Hupp, Sharonville; Catherine Jean Randall, Cincinnati, both of Ohio

[73] Assignee: The Procter & Gamble Company, Cincinnati, Ohio

[21] Appl. No.: 09/296,816

[22] Filed: Apr. 22, 1999

[51] Int. Cl.[7] ..... B65D 8/14

[52] U.S. Cl. ..... 220/666; 229/117.05; 383/32; 383/119; 383/120; 220/315

[58] Field of Search ..... 229/117.05; 220/4.26, 220/666, 315; 383/32, 120, 105, 119

[56] References Cited

U.S. PATENT DOCUMENTS

| | | | |
|---|---|---|---|
| 584,555 | 6/1897 | Lorenz . | |
| 605,343 | 6/1898 | Ross . | |
| 2,271,962 | 2/1942 | Weiner | 229/117.05 |
| 2,377,989 | 6/1945 | Braun | 383/119 X |
| 2,573,309 | 10/1951 | Chipkevich . | |
| 2,893,295 | 7/1959 | Magill . | |
| 2,925,949 | 2/1960 | Locke . | |
| 2,951,765 | 9/1960 | Robson . | |
| 3,197,062 | 7/1965 | Day et al. . | |
| 3,306,492 | 2/1967 | Kugler . | |
| 3,319,684 | 5/1967 | Calhoun . | |
| 3,462,067 | 8/1969 | Shore . | |
| 3,682,372 | 8/1972 | Rodley . | |
| 3,738,565 | 6/1973 | Ackley et al. | 383/119 X |
| 3,784,055 | 1/1974 | Anderson . | |
| 3,819,043 | 6/1974 | Harrison . | |
| 3,970,241 | 7/1976 | Hanson . | |
| 4,131,195 | 12/1978 | Worrell, Sr. . | |
| 4,183,458 | 1/1980 | Meyers . | |
| 4,185,754 | 1/1980 | Julius . | |
| 4,411,374 | 10/1983 | Hotchkiss . | |
| 4,420,080 | 12/1983 | Nakamura . | |
| 4,458,810 | 7/1984 | Mahoney . | |
| 4,487,318 | 12/1984 | Roen . | |
| 4,540,091 | 9/1985 | Haböck . | |
| 4,571,337 | 2/1986 | Cage et al. . | |
| 4,681,240 | 7/1987 | Wyant . | |
| 4,735,317 | 4/1988 | Sussman et al. . | |
| 4,736,450 | 4/1988 | Van Erden et al. . | |
| 4,753,351 | 6/1988 | Guillin . | |
| 4,790,436 | 12/1988 | Nakamura . | |
| 4,808,421 | 2/1989 | Mendenhall et al. . | |
| 4,833,862 | 5/1989 | Bortolani et al. . | |
| 4,848,930 | 7/1989 | Williams et al. . | |

(List continued on next page.)

FOREIGN PATENT DOCUMENTS

| | | | |
|---|---|---|---|
| 2232071 | 12/1990 | United Kingdom | 229/117.05 |

*Primary Examiner*—Stephen K. Cronin
*Assistant Examiner*—Robin Hylton
*Attorney, Agent, or Firm*—W. Scott Andes; Larry L. Huston; Donald E. Hasse

[57] ABSTRACT

A stackable, self-supporting container comprising: (a) a semi-enclosed container body including a tubular structure having two open ends and a bottom panel enclosing one end of the container body, the other end of the tubular structure opposite from the bottom panel forming a substantially continuous outwardly-extending peripheral flange, the tubular structure including two opposed side walls, two opposed end walls between the side walls, the side walls and said end walls together forming the tubular structure, each of the end walls including a central portion and a pair of opposing supporting flaps hingedly connected to the central portion and moveable between a position substantially planar with the central portion and a position substantially perpendicular with the central portion; (b) a lid for selectively converting the semi-enclosed container to a closed container; and (c) a closure element for sealing said lid to the container body. The closure element preferably includes a mechanical interlocking seal, and the supporting flaps are preferably unitarily formed with the central portion and preferably lock in the perpendicular position.

10 Claims, 3 Drawing Sheets

U.S. PATENT DOCUMENTS

| | | | |
|---|---|---|---|
| 4,863,064 | 9/1989 | Dailey, III . | |
| 4,892,220 | 1/1990 | Foos . | |
| 4,898,477 | 2/1990 | Cox et al. . | |
| 4,930,644 | 6/1990 | Robbins, III . | |
| 4,979,613 | 12/1990 | McLaughlin et al. . | |
| 5,044,774 | 9/1991 | Bullard et al. . | |
| 5,048,718 | 9/1991 | Nakamura . | |
| 5,050,737 | 9/1991 | Joslyn et al. . | |
| 5,061,500 | 10/1991 | Mendenhall . | |
| 5,076,436 | 12/1991 | Bortolani et al. . | |
| 5,145,091 | 9/1992 | Meyers . | |
| 5,195,829 | 3/1993 | Watkins et al. . | |
| 5,201,164 | 4/1993 | Kaufman . | |
| 5,242,057 | 9/1993 | Cook et al. . | |
| 5,314,252 | 5/1994 | Happ . | |
| 5,316,603 | 5/1994 | Akazawa et al. . | |
| 5,364,189 | 11/1994 | Kuge et al. . | |
| 5,379,897 | 1/1995 | Muckenfuhs et al. . | |
| 5,401,102 | 3/1995 | Faltynek et al. | 383/119 X |
| 5,439,132 | 8/1995 | Gorlich . | |
| 5,458,556 | 10/1995 | Hlubik | 383/119 X |
| 5,507,579 | 4/1996 | Sorenson . | |
| 5,524,990 | 6/1996 | Buck . | |
| 5,547,284 | 8/1996 | Imer . | |
| 5,575,747 | 11/1996 | Dais et al. . | |
| 5,577,627 | 11/1996 | Richie-Dubler . | |
| 5,605,594 | 2/1997 | May . | |
| 5,609,899 | 3/1997 | Spector . | |
| 5,662,758 | 9/1997 | Hamilton et al. . | |
| 5,731,021 | 3/1998 | Spector | 229/117.01 X |
| 5,996,882 | 12/1999 | Randall | 229/110.05 |

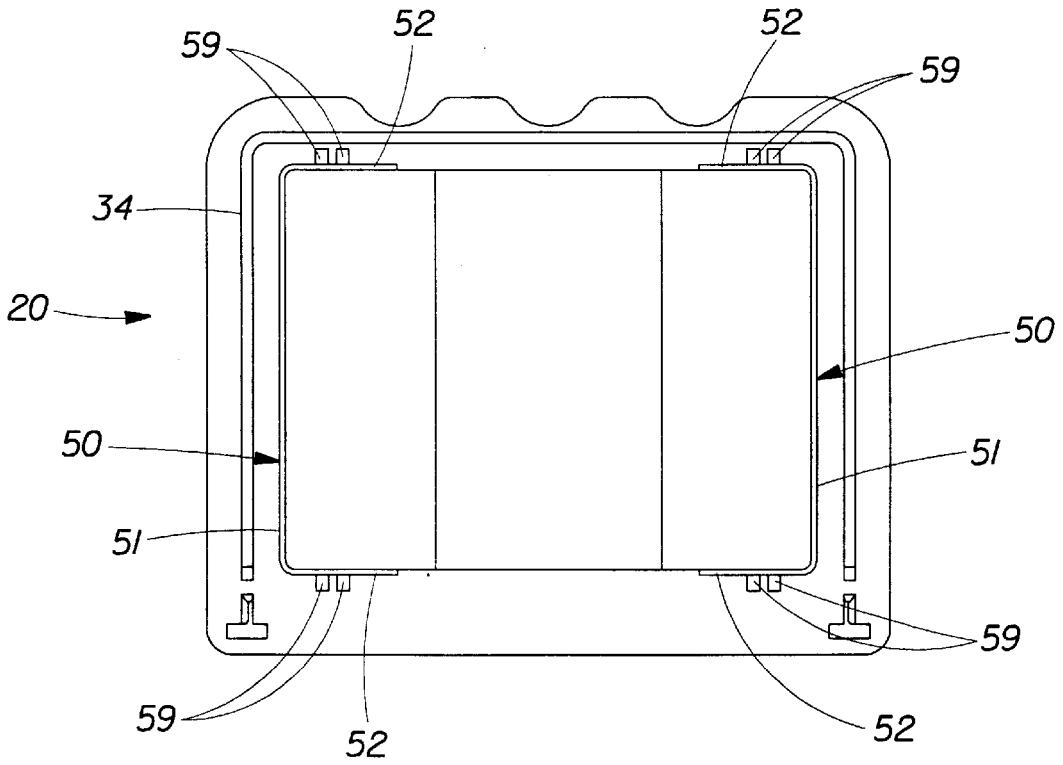
Fig. 3
Fig. 4
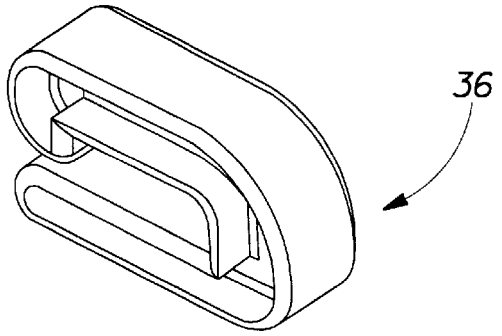
Fig. 5
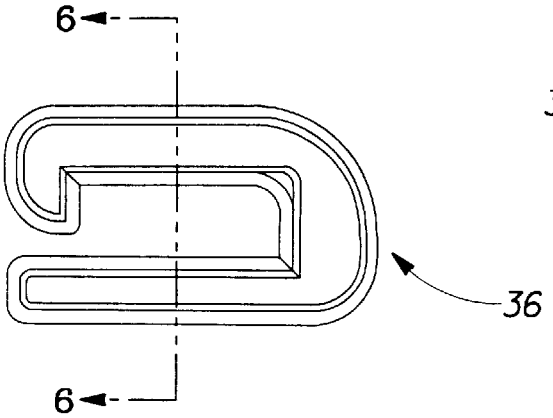
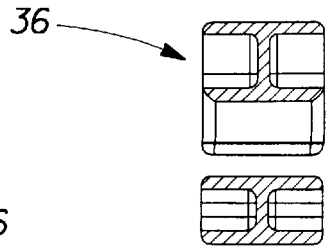
Fig. 6

COLLAPSIBLE, STACKABLE, SELF-SUPPORTING CONTAINER WITH SUPPLEMENTAL SUPPORT FEATURE

FIELD OF THE INVENTION

The present invention relates to storage containers, particularly those suitable for use in the containment and protection of various items including perishable materials. The present invention further relates to such storage containers having improved stability under a wide range of in-use conditions.

BACKGROUND OF THE INVENTION

In response to consumer interest, a number of comparatively inexpensive storage containers have been developed which are made of polymeric materials and which are suitable for a wide variety of storage uses. Such containers attempt to combine the advantages of both flexible storage bags and durable, reusable, stackable storage containers. These containers are made of inexpensive materials yet exhibit sufficient structural integrity to maintain their shape for ease of filling. Particularly useful are such containers which are collapsible for ease of storage when empty, yet are easily erected when ready for use. Representative storage containers of this variety are disclosed in commonly-assigned, co-pending U.S. patent applications Ser. Nos. 08/853,773 and 08/854,246, the disclosures of which are hereby incorporated herein by reference.

While storage containers of the latter variety provide a number of advantages versus containers of more rigid construction, the need to utilize materials having sufficient rigidity to be self-supporting limits the thinness and flexibility, as well as cost, of the range of materials which may be employed.

Accordingly, it would be desirable to provide a storage container which is collapsible and stackable, yet which can be made of thinner more flexible and inexpensive materials.

SUMMARY OF THE INVENTION

The present invention provides a stackable, self-supporting container comprising: (a) a semi-enclosed container body including a tubular structure having two open ends and a bottom panel enclosing one end of the container body, the other end of the tubular structure opposite from the bottom panel forming a substantially continuous outwardly-extending peripheral flange, the tubular structure including two opposed side walls, two opposed end walls between the side walls, the side walls and said end walls together forming the tubular structure, each of the end walls including a central portion and a pair of opposing supporting flaps hingedly connected to the central portion and moveable between a position substantially planar with the central portion and a position substantially perpendicular with the central portion; (b) a lid for selectively converting the semi-enclosed container to a closed container; and (c) a closure means for sealing said lid to the container body.

The closure means preferably includes a mechanical interlocking seal, and the supporting flaps are preferably unitarily formed with the central portion and preferably lock in the perpendicular position.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

FIG. 3 is a bottom plan view of a storage container similar to that of FIG. 1;

FIG. 4 is a perspective view of a representative slider element suitable for use in accordance with the present invention;

FIG. 5 is an elevational view of the slider of FIG. 4;

FIG. 6 is an elevational sectional view taken along line 6—6 of FIG. 5;

DETAILED DESCRIPTION OF THE INVENTION

Figure 1:
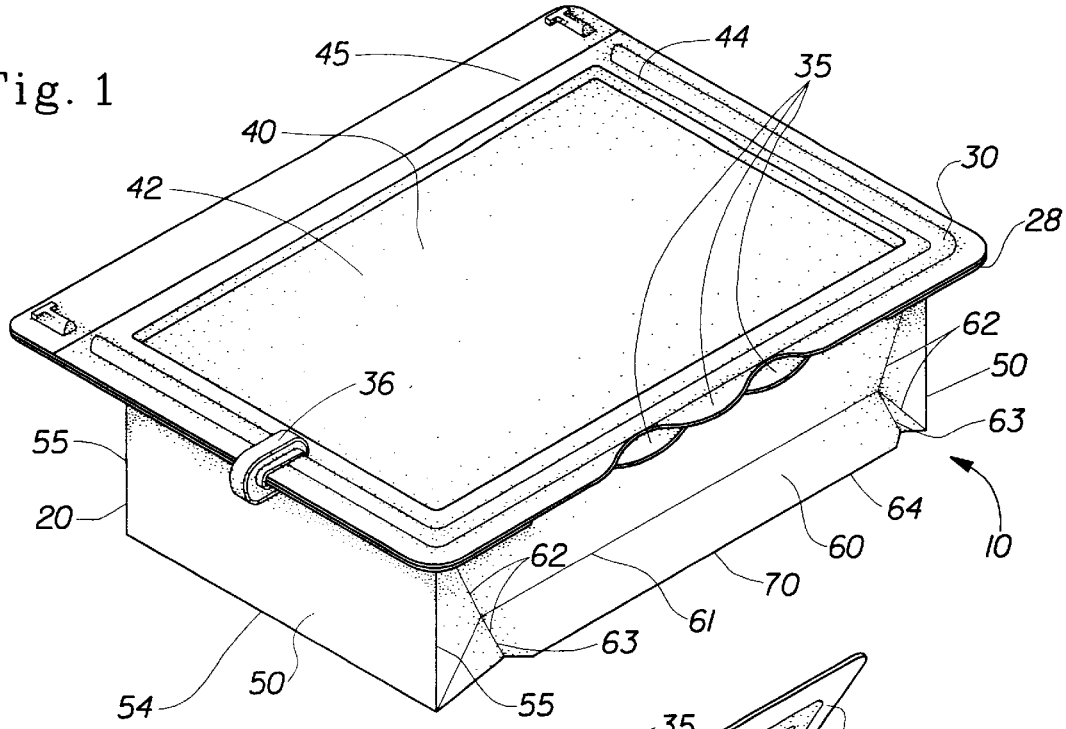
FIG. 1 is a perspective view of a storage container in accordance with the present invention in a closed condition.

FIG. 1 depicts a presently preferred embodiment of a storage container 10 according to the present invention. In the embodiment depicted in FIG. 1, the storage container 10 includes a container body 20 preferably unitarily formed from a piece of sheet material and a lid 40 preferably unitarily formed with the container body 20 or at least hingedly attached to the container body at hinge line 45. Storage container 10 also includes closure means 30 located adjacent to edge 28 for sealing the peripheral portions of the lid 40 and container body 20 to form a fully-enclosed container or vessel as shown in FIG. 1. Closure means 30 comprises the marginal portion of the lid 40 and the marginal flange portion 25 of the container body 20. Closure means 30 is selectively openable, sealable, and resealable, as will be described hereinafter. Hinge line 45 shown in FIG. 2 preferably comprises a unitary living hinge, and may optionally be provided as a line of weakness by scoring, perforations, or the like which may optionally permit the lid to be separated from the container body.

In the preferred configuration depicted in FIG. 1, the closure means 30 closure means is disposed along all portions of edge 28 except the hinged portion at hinge line 45. However, under some circumstances a closure means formed by a greater degree of encirclement (such as, for example, a closure means which completely encircles the opening in the absence of a hinge line) may provide adequate closure integrity. The flange 25 may be either unitarily formed with the container body 20 or provided as a separate material element joined to the container body. When provided as a separate, preferably more rigid material element, it is presently preferred that the container body material be formed into at least a small peripheral flange at its upper edge (defining the opening) with pleated corners so as to form a suitable junction point for joining the container body to the flange.

As shown in FIG. 1, a suitable closure means 30 comprises a mechanical interlocking seal which includes at least one mating or interlocking bead 32 and groove 34 pair of elements on mating portions of the flange 25 and lid 40. In a presently preferred embodiment, the bead 32 is unitarily formed with and projects upwardly from the flange 25 around the three free sides of the flange (i.e., not necessarily around the rear portion of the container behind the hinge) while the groove 34 has a complementary shape which is open on the bottom so as to receive the bead 32 therein. The closure means 30 also includes a sliding mechanical element or slider 36 which is captively engaged with the bead and groove so as to remain attached to the container unless one or more elements is deformed to permit its removal. Slider 36 is sized and shaped so as to be freely slideable over the bead and groove when they are fully engaged with one another to effect a sufficient closure seal. Slider 36 therefore functions to seal the bead and groove into one another when it is drawn around the periphery of the container from one side to another after the container has been opened. Other types of closure systems, such as adhesive-based or simple mechanical systems without a slider mechanism, may also be employed.

Figure 2:
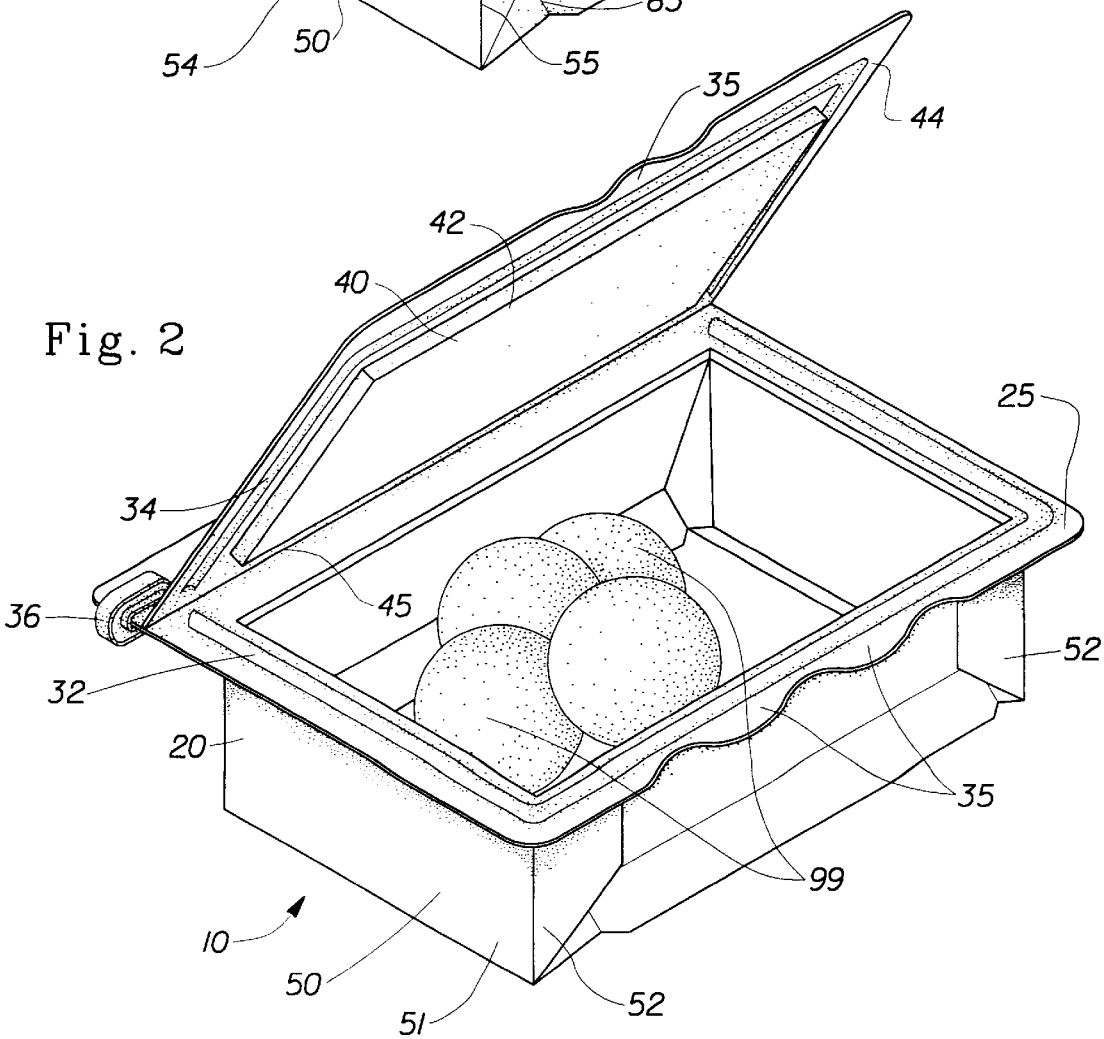
FIG. 2 is a perspective view of the storage container of FIG. 1 in an open condition and partially filled with solid objects.

Storage container 10 is suitable for containing and protecting a wide variety of materials and/or objects contained within the container body. FIG. 2 depicts the storage container 10 in an open condition wherein the closure means 30 has been released such that edge 28 may be opened to admit materials and/or objects into the interior of the body portion of the storage container 10. In FIG. 2 a plurality of generic solid objects 99 are shown within the storage container 10.

Lid 40 is preferably of unitary construction and comprises a central lid panel 42 and a lid frame 44, either of which may be formed of various elements if desired. The ability to construct the container of multiple composite elements permits the use of diverse materials such as transparent polymeric panels for lid panels or more rigid, resilient materials for flanges and lid frames independently of the tailoring of materials for the container body 20. As best shown in FIGS. 1 and 2, the central lid panel 42 preferably extends downwardly to form a pan-shaped lid which forms a plug seal by fitting into a complementary recess or shelf in the upper portion of the container body for enhanced sealing capability.

In accordance with the present invention, as shown in the embodiment of FIG. 1, the storage container 10 comprises two generally planar end panels 50, two generally planar, gusseted side panels 60, and a generally planar bottom panel 70, which panels form a semi-enclosed container having an opening defined by upper flange 25. End panels 50 include side edges 55 and bottom edges 54, while side panels 60 include bottom edges 64 and gussets of generally conventional design having converging base creases 62 and medial creases 61, with lateral creases 63. The creases are preferably formed into the material as lines of weakness via molding thinned areas into the material, scoring, or other suitable methods. In the configuration depicted in FIG. 1, the storage container is in its self-supporting, open condition. Flange 25 is preferably sufficiently resilient and rigid to aid in holding the open end of the container in an open condition as shown in FIG. 1.

To provide the enhanced self-supporting capability of the present invention, as shown in FIG. 2 the end panels referred to generally as 50 also include substantially symmetrical pairs of supporting flaps 52 which are hingedly attached along one edge to the central portion 51 of the end panel 50. These supporting flaps have been omitted from FIG. 1 in the interest of clarity to more clearly show the other sides and edges of the container. The central portion 51 may comprise a separate layer or material element which contains the supporting flaps 52 and is joined to the body 20 of the container, as is presently preferred, or may be unitarily formed with the end panel 50 which forms a wall of the container body 20 and is joined to the other sides. The use of a separate material element provides the opportunity to use a diverse, more rigid, material such as coated paper for the supporting flaps and central portion for enhanced stability, as well as other features such as label areas and thermal protection. The supporting flaps 52 may likewise be unitarily formed with the central portion 51, as is presently preferred, or may comprise a separate element hingedly connected to the central portion. When the supporting flaps 52 are in their deployed position, they form a plane which is substantially perpendicular with the plane of the central portion 51 of the end panel 50 and form a line of intersection along the corner of the container body 20. In this orientation, the supporting flaps 52 engage the flange 25 at their upper edge to brace the end panel 50 and prevent it from rotating inwardly or outwardly, which could lead to container collapse. Each end panel 50, with its central portion 51 and supporting flaps 52 in their engaged position, forms a structure with a substantially U-shaped cross-section which provides enhanced stability. The supporting flaps may also aid in the erection of the container as handles for unfolding the various elements.

FIG. 3, which is a bottom plan view of the storage container of FIGS. 1 and 2, illustrates the relationship of the end panels 50 with their central portions 51 and their supporting flaps 52. FIG. 3 also clearly illustrates another feature of the present invention, namely locking tabs 59 which serve as detents to retain the supporting flaps 52 in their stabilized or engaged position as shown in FIGS. 2 and 3. These locking tabs 59 preferably extend downwardly from the flange 25 of the container body 20 sufficiently far as to prevent the supporting flaps 52 from accidentally folding inwardly our outwardly to a non-supporting orientation, yet not so far as to not be overcome by a consumer when it is desired to fold or collapse the container, as described hereafter. Locking tabs 59 may be unitarily formed with the container or may comprise a separate element joined to the container by suitable means, and may be provided singly or as multiple side-by-side elements as desired. Additionally, other features such as ribs or a downwardly-extending edge of the flange may also provide this functionality.

While the storage container described above with regard to FIG. 1 provides many advantages compared with flexible storage bags and storage containers commonly available, it also includes additional features to enable the container to assume a self-supporting configuration to facilitate product access and product filling without manual support for greater ease of use.

As utilized herein, the term "flexible" is utilized to refer to materials which are capable of being flexed or bent, especially repeatedly, such that they are pliant and yieldable in response to externally applied forces. Accordingly, "flexible" is substantially opposite in meaning to the terms inflexible, rigid, or unyielding. Materials and structures which are flexible, therefore, may be altered in shape and structure to accommodate external forces and to conform to the shape of objects brought into contact with them without losing their integrity.

As utilized herein, the term "self-supporting" is utilized to refer to materials, structures, or containers which are capable of maintaining their orientation in a plane parallel to the direction of the force of gravity. For example, a self-supporting material, particularly a sheet material, may be held so that it extends upwardly parallel to the direction of the force of gravity and maintain its orientation without folding over or collapsing. Non-self-supporting materials typically will fold over or collapse and not be capable of being held parallel to the force of gravity (i.e., "vertically") unless they are held so that they extend downwardly from their point of support. Correspondingly, a self-supporting bag or container is capable of maintaining its orientation with surfaces extending upwardly from their base of support in opposition to the force of gravity without folding over upon itself or collapsing.

Figure 7:
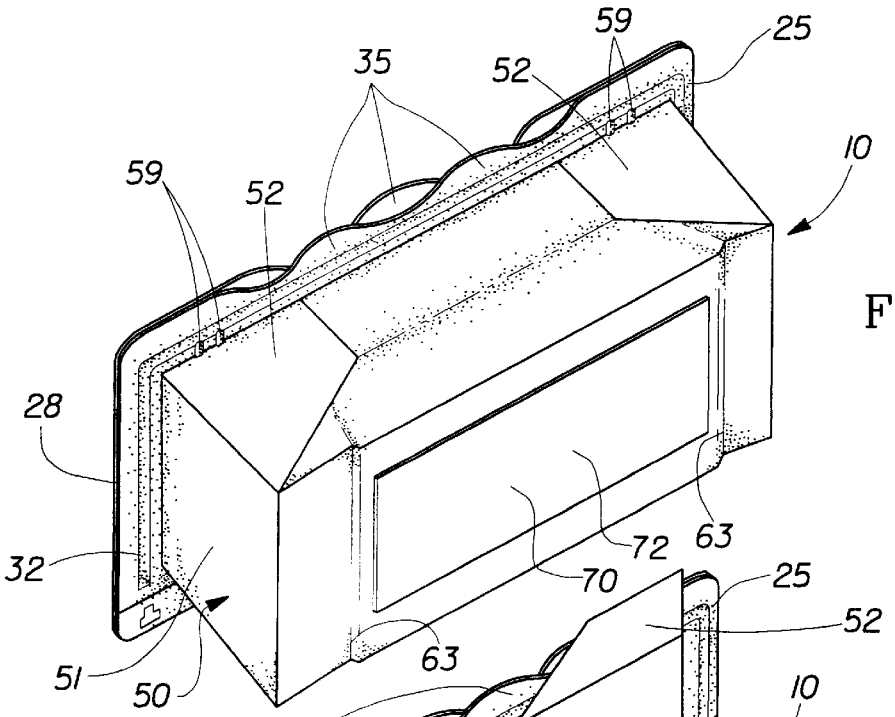
FIG. 7 is a perspective view of the storage container of FIG. 1 in a horizontal position in preparation for folding.
Figure 8:
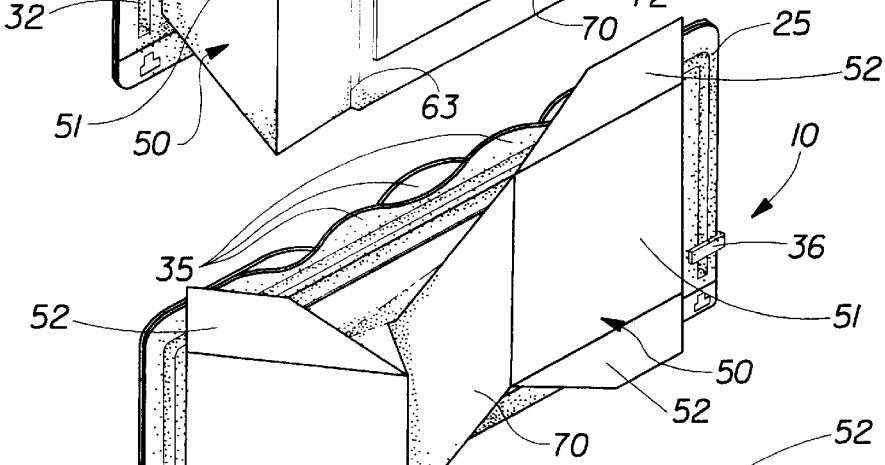
FIG. 8 is a perspective view of the storage container of FIG. 1 in a partially folded and collapsed condition.
Figure 9:
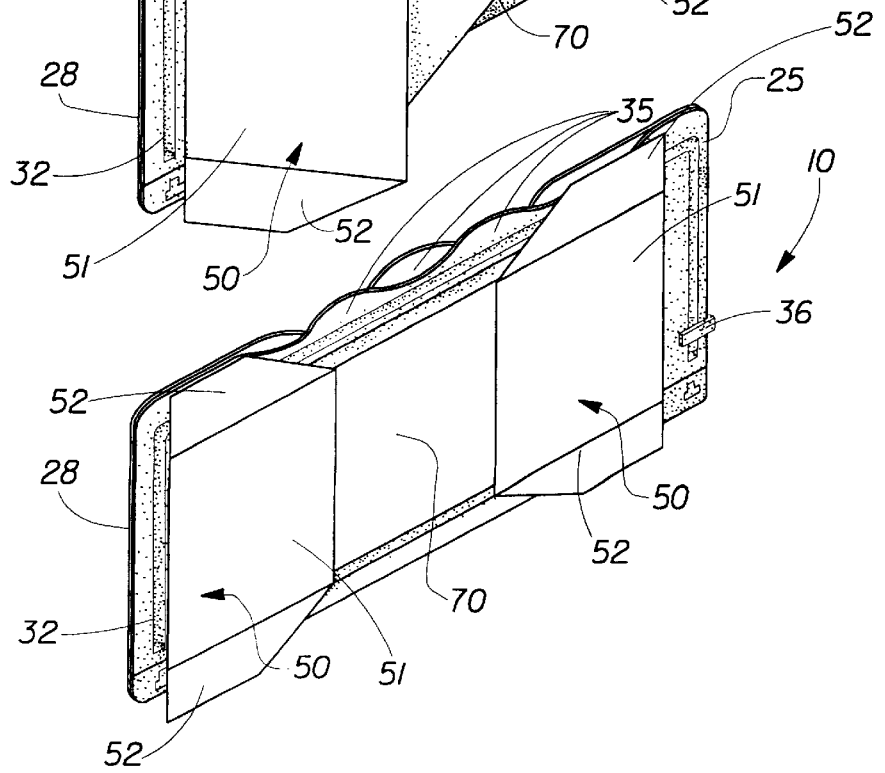
FIG. 9 is a perspective view of the storage container of FIG. 1 in a fully folded and collapsed condition.

In addition to being self-supporting, gusseted storage container 10 of the present invention is also readily foldable or collapsible to provide easy storage occupying minimal space. FIG. 7 depicts a gusseted storage container 10 as shown in FIG. 1 positioned laterally on its side in preparation for folding. FIG. 8 depicts a gusseted storage container 10 as shown in FIG. 1 but in a partially folded or collapsed condition. In order to fold the end panels 50 inwardly to collapse the container, i.e., to move from the condition of FIG. 7 to the condition of FIG. 8, the supporting flaps 52 must be disengaged from the locking tabs 59 and unfolded such that they are no longer substantially perpendicular with the central portion 51 but are instead substantially planar with the central portion 51. Accordingly, medial creases 61 have been pushed inwardly toward one another, bringing bottom edges 64 toward and generally parallel to the flange 25 FIG. 9 shows a gusseted storage container 10 in a more fully folded condition wherein folding continues until the bottom 70 is substantially parallel to and in close proximity to the flange 25 and the end panels are fully folded inwardly toward one another. Medial creases 61 could also be folded outwardly, if desired, which provides the additional feature of helping to erect the container when they are pushed inwardly. Also depicted in FIG. 7 is the optional reinforcing panel 72 which adds additional integrity and stability to the generally rectangular, planar bottom panel 70. To avoid negatively impacting upon the foldability of the container body, the reinforcing bottom panel 72 preferably includes creases which substantially align with lateral creases 63 for folding as depicted in FIGS. 7—9 or preferably is located between the creases 63, as shown.

The addition of additional reinforcement to the bottom panel lowers the center of gravity of the empty container for greater stability prior to and during filling, increases the stiffness of the bottom of the container for added stability in most circumstances filled or empty, and reduces the likelihood of the bottom of the container bowing when filled with heavier contents. The reinforcing panel may be of a similar material to the container body material or may be of a different more or less durable material, and is secured to the bottom panel by adhesive application or other suitable means. It is presently preferred that when a reinforcing panel is employed that it be placed on the exterior surface of the bottom panel rather than on the interior surface in order to provide support and reinforcement without adding additional surfaces, joints, and crevices on the interior of the container where they may provide sites for trapping portions of the contents and creating cleaning difficulties.

The flexible sheet material utilized to form the body of the container is sufficiently flexible and yieldable to accommodate the folding or collapsing of the container body between the open configuration of FIG. 1 and the closed configuration of FIG. 9 More particularly, the side panels 60 are sufficiently flexible to fold or pleat upon themselves as the end panels 50 pivot inwardly toward one another as the bottom panel 70 moves toward the lid 40.

Various compositions suitable for constructing the storage containers of the present invention include substantially impermeable materials such as polyvinyl chloride (PVC), polyvinylidene chloride (PVDC), polyethylene (PE), polypropylene (PP), aluminum foil, coated (waxed, etc.) and uncoated paper, coated nonwovens etc., and substantially permeable materials such as scrims, meshes, wovens, nonwovens, or perforated or porous films, whether predominantly two-dimensional in nature or formed into three-dimensional structures. Such materials may comprise a single composition or layer or may be a composite structure of multiple materials, including a substrate material utilized as a carrier for a substance. Materials found suitable for use in accordance with the present invention include a low density polyethylene film, 10 mil thickness, commercially available from Chevron under the manufacturer's designation PE1122. In order to avoid conflicts between the tabs and the operation of the slider, the tabs are preferably formed from the flange and lid material by removing portions thereof to leave isolated projections which project no further than the outer edge of the flange. As shown in the Figures, a sinusoidal edge for the flange and a phase-shifted sinusoidal edge for the lid have proven satisfactory.

FIG. 4 is an elevational perspective view of a preferred embodiment of a sliding mechanical element, or slider, 36 in accordance with the present invention. As shown in FIG. 4, and more prominently in FIG. 5, the slider 36 has a generally C-shaped configuration such that the ends of the slider can extend inwardly over the peripheral edges of the flange 25 and lid 40 in overlying relation to the bead 32 and groove 34. The portions of the slider 36 which overlie the bead and groove have a spacing therebetween which is sufficiently small as to force the bead and groove into interlocking engagement when the slider is translationally drawn over a region of the periphery where the bead and groove are separated.

The bead and groove are preferably spaced a substantially constant distance inwardly from the peripheral edge of the lid and flange such that a slider having an adequate inward extent can be drawn around the peripheral edge of the container without leaving gaps or unsealed portions of the bead and groove pair. In addition, while the closure mechanism of the present invention may be employed on containers having a circular, oval, elliptical, or other curvilinear cross-section, the closure mechanism of the present invention may be employed as shown in FIGS. 1—2 on containers of polygonal cross-section, such as rectangular and square containers, so long as the corners of the flange and lid, as well as the bead and groove pair, are suitably radiused at the corners so that their radius exceeds the minimum necessary for the slider to change direction.

In addition, while the present invention has been illustrated and described in the context of a container having a single bead and groove pair, other arrangements may be employed wherein one or more sliders may engage one or more mating pairs of beads and grooves where the beads and grooves are side by side to form consecutive seals, where they are end to end, or where they occupy separate unconnected regions of the container.

Materials utilized as a closure means in accordance with the present invention may be unitarily formed and constructed as part of the body of the storage container either before, during, or after assemblage of the container from its material components. Alternatively, such closure means may also be separately formed and joined to the body of the storage container either before, during or after assemblage of the container. The material utilized for the closure means may be the same as or different from the material utilized to form the container body either in dimensions or in composition. The closure means may also incorporate additional features such as texture for providing an audible or tactile signal when the slider is utilized or different colors on the bead and groove which yield a different color appearance when engaged (similar to commercially available closures on flexible bags).

In accordance with the present invention, the closure means 30 provides the user with an easy-to-operate closure means for closing and sealing an opening in a storage container. The closure means 30 is easy to manipulate, as the only dexterity required is to grasp or pinch the slider with a pair of opposed digits and move the slider across the extent of the opened portion of the lid to provides secure engagement of the bead and groove, thereby converting the storage container from a semi-enclosed container to a fully closed container. To open the storage container of FIG. 1, a user may grasp a pair of opposing tabs 35 and pull them in opposite directions to initiate and propagate separation of the opposed halves of flange 31, and hence closure means 30.

In addition to such use of sheet material folded and sealed to form the container body, the container body may be constructed in any known and suitable fashion such as those known in the art for making such containers in commercially available form. Heat or adhesive sealing technologies may be utilized to join various components or elements of the container to themselves or to each other. In addition, the container bodies may be thermoformed, blown, or otherwise molded from a starting blank or sheet of material rather than reliance upon folding and bonding techniques to construct the container bodies from a web or sheet of material.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A stackable, self-supporting container comprising:

(a) a semi-enclosed container body including a tubular structure having two open ends and a bottom panel enclosing one end of said container body, the other end of said tubular structure opposite from said bottom panel forming a substantially continuous outwardly-extending peripheral flange, said tubular structure including two opposed side walls, two opposed end walls between said side walls, said side walls and said end walls together forming said tubular structure, each of said end walls including a central portion and a pair of opposing supporting flaps hingedly connected to said central portion and moveable between a position substantially planar with said central portion and a position substantially perpendicular with said central portion;

(b) a lid for selectively converting said semi-enclosed container to a closed container; and (c) a closure means for sealing said lid to said container body.

2. The stackable, self-supporting container of claim 1 wherein said lid is attached to said container body.

3. The stackable, self-supporting container of claim 1, wherein said supporting flaps lock in the perpendicular position.

4. The stackable, self-supporting container of claim 1, wherein said lid is unitarily formed with said flange.

5. The stackable, self-supporting container of claim 1, wherein said container body includes locking tabs to secure said supporting flaps in the perpendicular position.

6. The stackable, self-supporting container of claim 5, wherein said side walls, said end walls, and said bottom panel are unitarily formed from a continuous sheet of material.

7. The stackable, self-supporting container of claim 5, wherein each of said side walls includes a gusset extending in a direction substantially parallel to said bottom panel, and wherein said side walls and said end walls are inwardly foldable toward one another, such that said container is collapsible in a direction normal to said lid and said bottom panel while being substantially self-supporting while said side walls and said end walls are in their unfolded orientation.

8. The stackable, self-supporting container of claim 1, wherein said supporting flaps are unitarily formed with said central portion.

9. The stackable, self-supporting container of claim 1, wherein said tubular structure has a substantially rectangular cross-sectional shape.

10. The stackable, self-supporting container of claim 1, wherein said lid is joined to said flange by a living hinge.

* * * * *